US008211239B1

(12) United States Patent
Johnson

(10) Patent No.: US 8,211,239 B1
(45) Date of Patent: Jul. 3, 2012

(54) METHOD OF CLEANING BEER KEGS AND OTHER BREWERY PROCESSING EQUIPMENT

(75) Inventor: Dana J. Johnson, Arvada, CO (US)

(73) Assignee: Birko Corporation, Henderson, CO (US)

( * ) Notice: Subject to any disclaimer, the term of this patent is extended or adjusted under 35 U.S.C. 154(b) by 0 days.

(21) Appl. No.: 12/586,174

(22) Filed: Sep. 18, 2009

Related U.S. Application Data

(60) Provisional application No. 61/192,572, filed on Sep. 19, 2008.

(51) Int. Cl.
*C23G 1/02* (2006.01)

(52) U.S. Cl. ..... 134/3; 134/2; 134/10; 134/22.1; 134/22.14; 134/22.19; 134/19; 134/36; 134/41; 134/42; 510/109; 510/421

(58) Field of Classification Search ..... 134/2, 3, 134/10, 22.1, 22.14, 22.19, 36, 41, 42; 510/109, 510/421
See application file for complete search history.

(56) References Cited

U.S. PATENT DOCUMENTS

| | | | | |
|---|---|---|---|---|
| 5,876,511 | A * | 3/1999 | Till | 134/22.1 |
| 6,042,629 | A * | 3/2000 | McGarrity | 71/25 |
| 2003/0064903 | A1* | 4/2003 | Coughlin et al. | 510/218 |
| 2009/0139546 | A1* | 6/2009 | Laffitte et al. | 134/22.19 |

OTHER PUBLICATIONS

Birko Corporation, Brewery Products, Nov. 2010, pp. 1-2.*
Birko Corporation, Birko Product List 2010, Nov. 2010, pp. 1-3.*

* cited by examiner

*Primary Examiner* — Bibi Carrillo
(74) *Attorney, Agent, or Firm* — TraskBritt, P.C.

(57) ABSTRACT

A method for cleaning used beer kegs employing an aqueous solution of phosphoric acid, nitric acid and one or more surfactants, e.g., a detergent and/or wetting agent. Preferably, the aqueous cleaning solution has a total nitric acid content of 12 wt % or less. Complete cleaning can be achieved without using any caustic. The cleaning solution can be recycled repeatedly to clean multiple kegs on numerous occasions over a period of time, e.g., several weeks.

3 Claims, No Drawings

METHOD OF CLEANING BEER KEGS AND OTHER BREWERY PROCESSING EQUIPMENT

I. RELATED INVENTIONS

This application claims priority from provisional patent application Ser. No. 61/192,572 filed on Sep. 19, 2008, which is incorporated by reference herein.

II. FIELD OF THE INVENTION

The present invention relates to an improved method for cleaning used beer kegs for recycling, i.e., so that they can be refilled and redistributed without contamination from the after-effects of prior use.

III. BACKGROUND OF THE INVENTION

Although brewers supply beer in bottles and cans as individual servings, a significant amount of beer is supplied in larger sized kegs (½ barrel, or 15.5 gal.) or half kegs (¼ barrel or 7.75 gallon) and 0.6 barrel (i.e., 5 gallon) kegs. Kegs are convenient for breweries, distributors and users in storing, chilling, and transporting beer. They are also a convenient means to dispense multiple servings through a tap attached to the keg. Kegs are particularly useful for dispensing beer in commercial establishments and at events.

A significant disadvantage of using kegs is that they are difficult to clean, sanitize, and reuse. The unused beer and protein inside the dark wet keg is a perfect environment for microorganisms to incubate and grow. In addition, the other components of the unused beer form "soil" and may contain "beerstone," which is very difficult to remove. Microorganisms, soil and beerstone must be cleaned from the keg before reuse. Otherwise, there is a potential for risk of contamination, off-flavors and even health risks to the consumer. Beerstone harbors microorganisms, making the inside surface of the keg impossible to sanitize. Accordingly, the keg must be cleaned effectively, and the cleaning process itself should not leave a chemical residue. All of this must be accomplished in an economical manner.

Cleaning kegs in breweries has traditionally been accomplished by using hot water and alkaline liquid cleaning solutions comprised of sodium and/or potassium hydroxide. Sodium hydroxide (NaOH) and potassium hydroxide (KOH) utilize extremely high (e.g., 12-14) pH to hydrolyze (i.e., break down) soil to remove it. Sodium hydroxide is also known as "caustic soda" or "lye" and potassium hydroxide is known as "caustic potash." In the last few decades, formulators have included surfactants (i.e., detergents) and sometimes chlorine bleach (i.e., sodium hypochlorite) or hydrogen peroxide along with the caustic to assist wetting and protein removal. Caustic cleaning solutions are used in the brewery because they are relatively inexpensive, can be recycled (i.e., re-used) and do a good job of removing protein-based soils. They do not, however, address calcium and magnesium hard water scale deposits nearly as well as acidic cleaning solutions. Like steam cleaning, which is also employed in some keg cleaning operations, the use of caustics presents hazards to workers who must handle or come in contact with those chemicals.

A decade ago, craft brewers began using a new generation of non-caustic, alkaline, oxygenated cleaning solutions instead of using caustic. These powdered non-caustic alkaline cleaners are safer for employees than their caustic predecessors due to their lower pH at the point of use. But non-caustic cleaners tend to cost more per pound than caustics. Also, they do not remove, and perhaps even promote, beerstone. "beerstone" is a hard organo-metallic scale that deposits on fermentation equipment and is chiefly composed of calcium oxalate or ($C_2CaO_4$). Accordingly, many brewers still use caustic cleaners in conjunction with the non-caustic cleaners to obtain complete removal of protein soil and beerstone. Cleaning with acid can be used as well, but breweries either use caustic, then neutralize with acid, or use acid only as a remedial step to remove beerstone.

In addition to the foregoing considerations, the spent cleaning solution must be environmentally friendly when discharged. Even more preferably, the cleaning solution should be capable of being recycled, which minimizes environmental impact and decreases the cost of the cleaning operation.

Thus, a need exists for providing an improved means for cleaning kegs, other beer containers and brewery equipment that is effective, safe, inexpensive and environmentally friendly.

IV. SUMMARY OF THE INVENTION

It has now been found that these needs can be met by cleaning kegs with an aqueous solution of phosphoric acid, nitric acid and one or more surfactants, e.g., a detergent and/or wetting agent. Preferably, the aqueous cleaning solution has a total nitric acid content of 12 wt % or less. Complete cleaning can be achieved without using any caustic. The solution is economically superior to prior cleaning solutions. Surprisingly, the cleaning solution can be recycled repeatedly to clean multiple kegs on numerous occasions over a period of time, e.g., several weeks.

V. BRIEF DESCRIPTION OF THE DRAWINGS

There are no drawings.

VI. DETAILED DESCRIPTION OF THE INVENTION AND A PREFERRED EMBODIMENT

It has now been found that beer kegs can be effectively and efficiently cleaned with an aqueous solution of phosphoric acid, nitric acid and a detergent and/or wetting agent with a total nitric acid composition of 12 wt % or less being preferred.

The combination of nitric and phosphoric acids is particularly useful for cleaning the residue inside kegs. Nitric acid ($HNO_3$) is extremely reactive with organic soil. Unlike phosphoric, sulfuric, and hydrochloric acid, which are mineral acids, nitric acid is an oxidizing acid which assists in breaking down the amino acids which are the building blocks of protein. In addition, nitric acid is known by those skilled in the art of metallurgy as being a "passivating" acid, which means that it leaves stainless steel in a "passive" state so the metal is not corroded by the beer and salts in water. Phosphoric acid ($H_3PO_4$) is used in the formulation to act as a pH buffer. While nitric acid only has one acid site, phosphoric acid has three acid sites.

Phosphoric acid is preferably used in an amount of from about 2-34%[1] of the cleaning additive for the aqueous solution. Nitric acid is preferably used in an amount of about 4-20% and more preferably in an amount of about 6-12%. It is also possible that these acids could be substituted in part with some other type of mineral acid, namely sulfuric acid.

[1]Unless otherwise indicated, all percentages are on a weight per weight basis.

In general the phosphoric and nitric acid component can comprise:

| | |
|---|---|
| Phosphoric acid | 2-34% active |
| Triton CF 32 | 0.5-1.0% |
| Nitric acid | 4-20% |
| Water | balance water |

A particularly useful blend of acids is:

| | |
|---|---|
| Phosphoric acid | 4-8% active |
| Triton CF 32 | 0.5-1.0% |
| Nitric acid | 12% active |
| Water | balance |

Such a formulation is sold under the designation ULTRA NITER™ by Birko Corporation of Henderson, Colo. ULTRA NITER™ is a nitric acid/phosphoric acid blend that has been employed as a passivating and/or descaling acid and as a caustic neutralizer in both the meat packing and brewery industries.

While nitric and phosphoric acid are useful cleaning agents, by themselves, they are not particularly good at penetrating the soil residues inside a used keg. Accordingly, it is helpful to employ one or more surfactants, particularly those that "wet out" and reduce the surface tension of the soil, so that the cleaning solution can penetrate deeply. Generally, non-ionic, alcohol ethoxylated surfactants that can perform this function are useful. In addition, the use of polymer dispersing agents is helpful to keep the penetrated soils in suspension. Generally, at least about 2-3% of one or more appropriate surfactants should be employed.

Because nitric acid is an oxidizing acid, it is difficult to find a compatible surfactant.

A particularly useful wetting agent is a blend of the following:

| | |
|---|---|
| Acumer 5000 (a polymer available from Rohm & Haas, Philadelphia, PA) | 1.17% |
| Acusol 505-N (a polymer available from Rohm & Haas, Philadelphia, PA) | 2.34% |
| Rhodoline 142 (a polymer available from Rhodia, Inc., Cranbury, NJ) or Dequest 2000 (Brenntag, Antwerp, Belgium) | 1.17% |
| Briquest 301-50A (a sequesterant available from ThermPhos, Switzerland) | 1.17% |
| Genapol UD-080 (a non-ionic surfactant available from Huntsman, Woodlands, TX) | 5.85% |
| Makon NF-12 (a non-ionic surfactant available from Stepan Company, Northfield, IL) | 5.85% |
| PnP Solvent (a solvent available from Huntsman, Woodlands, TX) | 5.85% |
| Bioterge PAS-8S (Stepan Company, Northfield, IL) | 5.85% |
| Genapol UD-030 (a non-ionic surfactant available from Huntsman, Woodlands, TX) | 2.34% |
| Citric Acid, Anhyd. FG (an organic acid available from Univar, Redmond, WA) | 1.17% |
| Triton CF 32 (a non-ionic surfactant available from Dow Chemical, Midland, MI) | 1.75% |
| Water (deionized) | balance |

The foregoing formulation is sold under the designation X-PUMA™ by Birko Corporation of Henderson, Colo. X-PUMA™ is a detergent additive that has generally been employed as an acid or caustic aid in both the meat packing and brewing industries.

The acids and surfactant should be blended to form an aqueous solution effective for removing the residue from and cleaning kegs. In one preferred embodiment about 1-2 oz. of ULTRA NITER™ and about 250-500 ppm of X-PUMA™ can be employed per gallon of water.

The resulting pH of the solution at dilution should be in the range of about 1.0-1.5. At this pH, any remaining microbes will hopefully be destroyed and the protein and beerstone removed as well.

The aqueous solution of the present invention can be used in any standard, commercial method for cleaning kegs either manually or automated. In a preferred embodiment the acid and detergent/wetting agent components can be used in an aqueous solution at about 120-140° F. An advantage of the present invention is that cleaning can be effectively accomplished without using extremely high water temperatures. Using a temperature in excess of 140° F. can "set" protein and beerstone making it more difficult to remove later.

In a preferred process of the present invention a used keg is rinsed first with potable warm water. This is particularly helpful when the keg contains the residue from unfiltered beer. Subsequently, the cleaning solution is then employed to clean and remove residue from the keg and finally the keg is subjected to "triple rinsing" with warm water. All of these steps can be accomplished with water at a maximum temperature of 140° F.

Another advantage of the present invention is that the cleaning solution is not neutralized by carbon dioxide ($CO_2$) remaining in kegs. Typically the carbon dioxide neutralizes the sodium hydroxide, caustic reducing the pH and the cleaning efficacy. The method of the present invention doesn't have this problem and is unaffected by residual carbon dioxide in the used kegs.

The use of the present invention is beneficial in that: (a) it results in complete cleaning of the kegs or vessels without the use of caustic, (b) it is safe and provides minimal risk to workers; and (c) it is inexpensive in that the cleaning solution itself is less expensive and in that the cleaning solution can be continuously recycled for additional keg cleaning operations. Indeed, one of the surprising results of the invention has been the ability to continuously recycle the cleaning solution for several weeks or more thereby providing economic benefits far in excess of those anticipated.

VII. EXAMPLE

A test was performed at a commercial micro-brewery that traditionally used about 190 ml of chlorinated caustic (i.e., more than 6.4 ounces) per keg for cleaning. The spent caustic was not recycled, and the process was very costly.

Subsequently, the micro-brewery employed an automated keg cleaning and sanitizing machine with a 60 gallon reservoir for recycling the cleaning solution. The keg cleaning and sanitizing machine is a commercially available machine from Comac/Eurosource, Inc. 2351 W. Northwest Hwy. Ste. 1105 Dallas, Tex. 75220. The Comac machine performed the cleaning operation as follows:

- a compressed air purge to remove any remaining beer and carbon dioxide from the keg,
- a hot water rinse,
- a cleaning cycle with cleaning solution from the reservoir,
- three burst rinses with hot water, and
- a steam sanitizing cycle.

To prepare the cleaning solution, the 60 gallon reservoir was filled with water and charged with one gallon of ULTRA NITER™ acid combination and two ounces of X-PUMA™ detergent additive. The resulting aqueous cleaning solution contained about 2 ounces per gallon of the nitric/phosphoric acid blend and only about 250 parts-per-million (ppm) of the detergent additive. The pH of the solution was 1.0-1.5. The solution also tested out to 3000 ppm as phosphoric acid using a LaMotte Acidity test kit.

The micro-brewery used the cleaning solution in the manner indicated to clean and sanitize hundreds of kegs from a single charging of the reservoir. Used cleaning solution from the process was recycled to the reservoir and repeatedly reused. The tank was dumped after 2-3 weeks of use, not because of any perceived deficiency in the cleaning solution—but out of an abundance of caution. During that time period, kegs were cleaned in a commercially acceptable manner, i.e., removal of soil with no remaining contamination. At the end of the test, the remaining solution was safely poured down a floor drain into a catch basin.

The invention claimed is:

1. A method for cleaning a used beer keg without application of a caustic, the method comprising cleaning the keg with an aqueous cleaning solution comprising phosphoric acid, nitric acid, one or more polymer dispersing agents, water, and a wetting agent, the aqueous cleaning solution having a total nitric acid content of between about 4 wt % and 20 wt % and having a wetting agent content of at least about 2 wt %, wherein the wetting agent comprises one or more non-ionic surfactants.

2. The method of claim 1, wherein the phosphoric acid comprises 2-34 wt %.

3. The method of claim 1 wherein the aqueous cleaning solution is recycled for subsequent keg cleaning treatments.

* * * * *